US006350207B1

(12) United States Patent
Arcuri

(10) Patent No.: US 6,350,207 B1
(45) Date of Patent: Feb. 26, 2002

(54) PUTTER TRAINING APPARATUS

(76) Inventor: Joseph T. Arcuri, 132 Charles St., Auburndale, MA (US) 02466

( * ) Notice: Subject to any disclaimer, the term of this patent is extended or adjusted under 35 U.S.C. 154(b) by 0 days.

(21) Appl. No.: 09/596,704

(22) Filed: Jun. 19, 2000

(51) Int. Cl.[7] ..... A63B 69/36

(52) U.S. Cl. ..... 473/223; 473/265; 473/258; 473/229

(58) Field of Search ..... 473/229, 219, 473/257, 258, 261, 262, 263, 264, 265, 260, 223, 225; 434/252; 482/101, 98, 132

(56) References Cited

U.S. PATENT DOCUMENTS 2,084,902 A * 6/1937 Eisenberg
2,303,736 A * 12/1942 Hall
3,104,108 A * 9/1963 Robertson
3,471,155 A * 10/1969 Donaldson
3,885,796 A * 5/1975 King
4,111,426 A * 9/1978 Goodwin
4,437,669 A * 3/1984 Pelz
4,984,802 A * 1/1991 Barraclough
5,074,565 A * 12/1991 Tucker
5,125,844 A * 6/1992 Grant

* cited by examiner

*Primary Examiner*—Sebastiano Passaniti
(74) *Attorney, Agent, or Firm*—William Nitkin

(57) ABSTRACT

A golf putting practice device having a rectangular guide housing within which a cylinder can be moved back and forth by attachment with a putter shaft, such movement being in a straight line to guide the putter shaft. A striker is attached to an end of the cylinder to hit a golf ball.

4 Claims, 2 Drawing Sheets

PUTTER TRAINING APPARATUS

BACKGROUND OF THE INVENTION

1. Field of the Invention

The device of this invention resides in the area of golf putting training apparatuses and more particularly relates to a device which can be utilized for repetitive, controlled practice putting motion.

2. History of the Prior Art

It has long been recognized that in the game of golf putting is an important part of the game of golf. Although one may have good drive and approach shots, if one does not sink a putt within a minimal number of putting strokes, one cannot be successful at the game. It has long been recognized that practice of repetitive correct motions can aid a golfer in repeating such correct motion while making the actual shot. To this end many devices have been created to aid golfers in creating a muscle memory of the correct putting movement necessary for successful putting. These devices control the direction of movement of the putter as the golfer swings and by repetitive use of such devices, a golfer can acquire a muscle memory that can be repeated when actually playing the game. Such devices arc exemplified in U.S. Pat. No. 2,084,902 to Eisenberg; U.S. Pat. No. 3,471,155 to Donaldson; U.S. Pat. No. 3,104,108 to Robertson; and U.S. Pat. No. 4,111,426 to Goodwin. These devices all control the movement of a putter while the golfer is practicing putting strokes so that the movement is in a substantially straight line with the club held at a proper angle.

SUMMARY OF THE INVENTION

It is an object of this invention to provide an improved device for practicing the putting stroke. To this end a metal guide housing is provided in which a cylinder member slideably moves and a putter shaft is pivotally attached to the cylinder member. The cylinder member moves within the guide housing, as described below, only in a straight direction to help train the golfer to repeat such stroke. A striker member which is attached to the cylinder member can strike a golf ball if the golfer desires to see the results of such putting practice movements.

DESCRIPTION OF THE PREFERRED EMBODIMENT(S)

Figure 1:
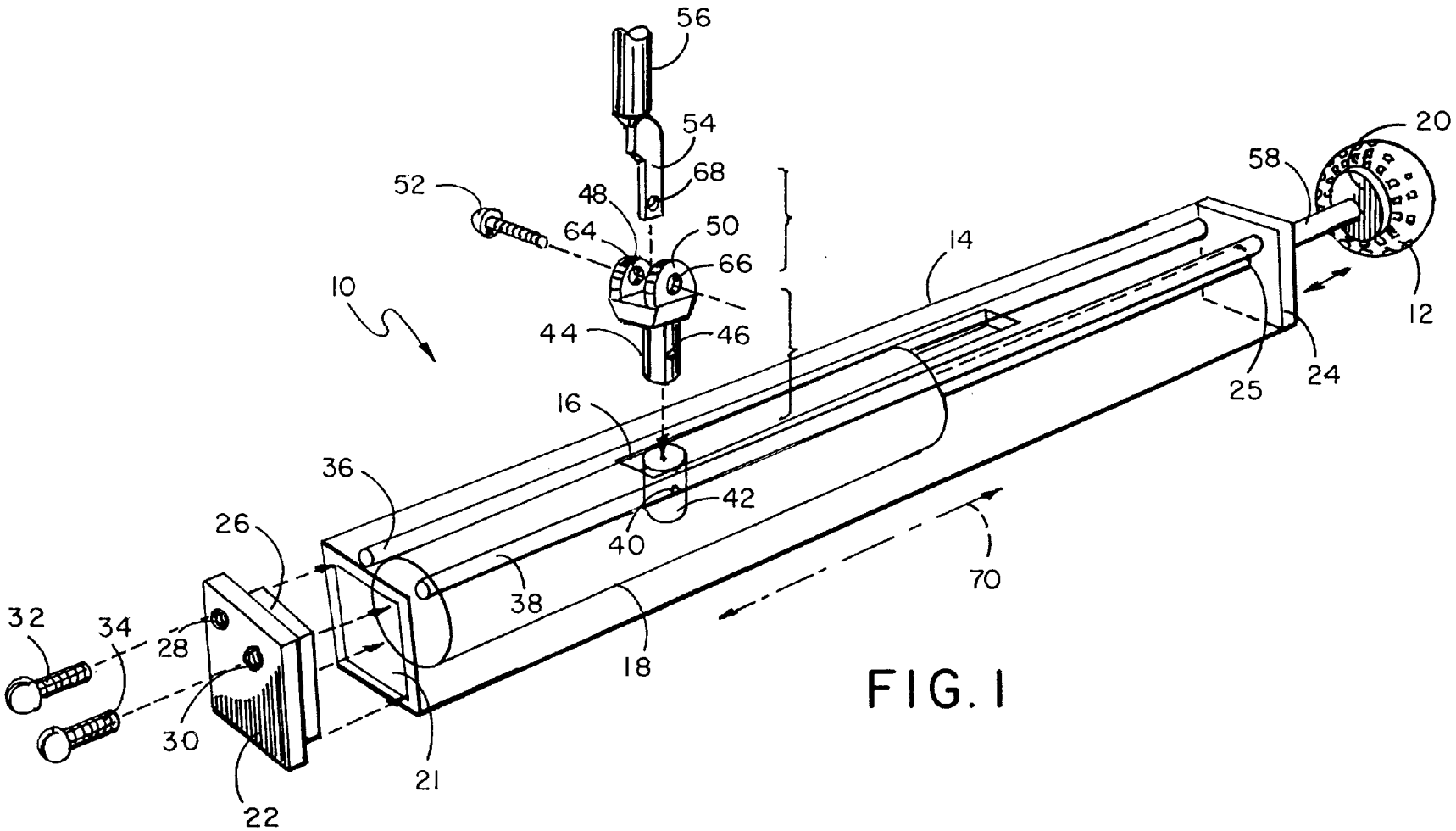
FIG. 1 illustrates a perspective view of the Putter Training Device of this invention with parts thereof shown separated from one another.

FIG. 1 illustrates a perspective view of the putter training device 10 of this invention. Seen in this view is hollow rectangular guide housing 14 having a first and second end which guide housing in a preferred embodiment can be made of metal so as to provide sufficient weight to the device for it to remain in position unaffected by the swing of the putter shaft. The rectangular hollow housing can be approximately 22 inches in length and approximately 2 inches in height and 2 inches in width. The inner side walls can be approximately ¼ inch thick. At the top surface of housing 14 is defined a slot approximately 11 inches long and about ½ inch wide which can have ¼ inch chamfered edge around it.

Figure 2:
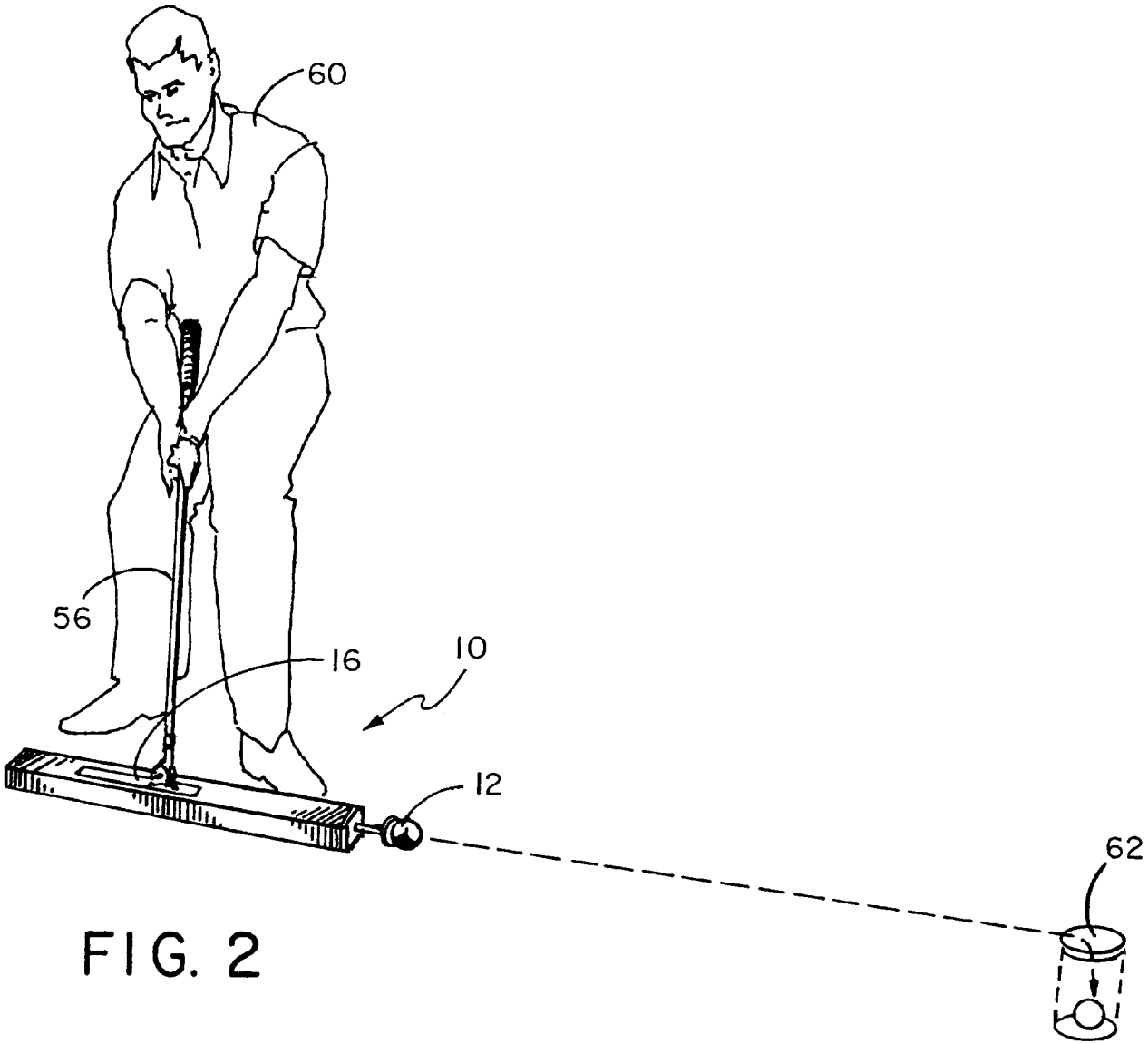
FIG. 2 illustrates a perspective view of a golfer using the device of this invention to hit a practice stroke and hit a golf ball at a hole.

Within guide housing 14 is slideable cylinder 18 which can be made of nylon or other equivalent plastic. A weight of approximately 5 lbs for the device of this invention has been found satisfactory. Cylinder 18 can be approximately 11 inches long and have a tapped hole at its front end and a centrally disposed bore 40 being approximately ½ inch diameter defined in its top. The cylinder can be approximately 1.5 inches in diameter and will slide easily within the hollow guide housing 14. Disposed at the rear first end of guide housing 14 is first end cap 22 which can be approximately ½ inch in width with a protruding insert portion 26 adapted to fit inside the first end opening 21 of guide housing 14. A second end cap 24 can be provided at the front second end of guide housing 14 and can have a 9/16 inch central aperture 25 defined therein through which aperture will pass striker shaft 58 which can have threads at each end. The threads at one end of striker shaft 58 can be engaged to the threads of striker member 20 positioned on the exterior side of second end cap 24. The other threaded end of striker shaft 58 can be screwed into the tapped front end of cylinder 18, as seen in FIG. 1. First and second tension rods 36 and 38 can extend along the inside top corner edges of the guide housing from one end to the other, each tension rod being approximately ¼ inch in diameter and having tapped ends. Each end cap, such as first end cap 22, can have a pair of apertures such as first end cap aperture 28 and second end cap aperture 30 defined therein for receipt therethrough, respectively, of first screw 32 and second screw 34 which, when first end cap 22 is positioned so that first end cap insert 26 fits within the first end of guide housing 14, the screws will pass, respectively, through first and second end cap apertures 28 and 30 and be screwed into the tapped ends of first and second tension rods 36 and 38 to retain them in position. Similar screws, not seen in FIG. 1, hold the opposite front ends of first and second tension rods 36 and 38 in position when such screws pass through similar apertures that are formed in second end cap 24. The tension rods urge against slideable cylinder 18 and help provide a spring-like tension on the slideable cylinder 18 as it moves back and forth within the guide housing 14. Bore 40 is defined in the central portion of the slideable cylinder 18 and can be approximately ½ inch in diameter and about ⅞ inch deep and have a detent 42 formed therein. Bore 40 is aligned with slot 16, and an insert member being pivot insert 44 which can be made of nylon or delrin or other equivalent material is adapted to be inserted within bore 40 to a position where spring plunger 46 engages into detent 42 to help prevent pivot insert 44 from rotating in position. At the top of pivot insert 44 is formed first pivot receipt side member 48 and second pivot receipt side member 50 which are adapted to receive the bottom end of putter shaft 56 which is formed into pivot attachment 54 which is flattened with aperture 68 defined therein such that pivot screw 52 can pass through aperture 64 formed in first pivot receipt side member 48, through aperture 68 in pivotal attachment 54 and then engage with threads in aperture 66 within second pivot receipt side member 50 so as retain the putter shaft 56 to pivot insert 44 and to slideable cylinder 18 such that movement of putter shaft 56, as seen in FIG. 2, by golfer 60 will cause putter shaft 56 and its attached pivot insert 44 to move back and forth along axis 70 within slot 16 while at the same time moving slideable cylinder 18 back and forth within guide housing 14. This action gives the golfer practice with a very good feeling of just the right amount of resistance to movement along with practice moving the putter shaft 56 straight in a back and forth manner. By having striker shaft 58 attached at the front second end of the slideable cylinder, when the putter shaft is moved forward moving slideable cylinder 18 forward within guide housing 14, striker shaft 58 moves through aperture 25 advancing striker member 20 against ball 12 so that one can actually practice putting a golf ball, for example, into hole 62 as seen in FIG. 2, so that one can actually practice putting a real golf ball using the device of this invention. Pivot insert 44 does have some side-to-side lateral movement within sides of slot 16 along with some minimal rotation of slideable cylinder 18 within the hollow guide housing 14, and there is also some movement of pivotal attachment 54 of putter shaft 56 in the upper portion of the insert where pivotal attachment 54 attaches by pivot screw 52 between first and second pivot receipt side members 48 and 50 which various movements also allow the device to adjust pivotally during the swing and for golfers of various heights and various stances.

FIG. 2 illustrates a golfer 60 utilizing and benefiting from practicing with the device of this invention which controls the back-to-front movement of the putter shaft in a straight line, yet still gives the golfer the opportunity to learn from the experience of hitting an actual golf ball 12 the distance and direction that the golf ball will travel toward cup 62.

Although the present invention has been described with reference to particular embodiments, it will be apparent to those skilled in the art that variations and modifications can be substituted therefor without departing from the principles and spirit of the invention.

I claim:

1. A golf putter practice device, comprising:

a rectangular guide housing having a hollow interior, a front, a rear, an upper interior portion, a top and first and second ends, said first and second ends disposed, respectively, at said rear and front of said guide housing;

a slot having a length defined in a straight line in the top of said guide housing, said slot having first and second sides along its length;

a cylinder having a top, a first end and a second end disposed, respectively, toward said rear and front of said device, and a weight, said cylinder slideably retained within said hollow interior of said guide housing;

a putter shaft having a bottom end; and means of attaching said bottom end of said putter shaft to said cylinder through said slot defined in the top of said guide housing for allowing said putter shaft to move back and forth in a straight line, with the direction of movement of said putter shaft being controlled by said first and second sides of said slot and by said weight of said slideable cylinder moving within said guide housing.

2. The device of claim 1 further including:

a bore formed within said top of said cylinder; and an insert member pivotally attached to said bottom end of said putter shaft, said insert member adapted to be engaged within said bore through said slot in the top of said guide housing.

3. The device of claim 2 further including:

first and second tension rods extending between said first end and said second end of said guide housing and disposed within said upper interior portion of said guide housing, said first and second tension rods for applying tension against the movement of said cylinder in said guide housing.

4. The device of claim 3 further including:

an aperture formed in said second end of said guide housing;

a striker shaft having a first end and a second end, said first end of said striker shaft attached to said cylinder at said second end of said cylinder, said striker shaft passing through said aperture in said second end of said guide housing; and said second end of said striker shaft adapted to strike a golf ball.

* * * * *